United States Patent [19]

Kaneda

[11] Patent Number: 4,529,914

[45] Date of Patent: Jul. 16, 1985

[54] HIGH INTENSITY DISCHARGE LAMP IGNITION SYSTEM

[75] Inventor: Isao Kaneda, Otsu, Japan

[73] Assignee: NEC Home Electronics, Ltd., Osaka, Japan

[21] Appl. No.: 530,876

[22] Filed: Sep. 12, 1983

[30] Foreign Application Priority Data

Sep. 30, 1982 [JP] Japan ..... 57-173596
Sep. 30, 1982 [JP] Japan ..... 57-173597

[51] Int. Cl.[3] ..... H01J 11/04

[52] U.S. Cl. ..... 315/335; 315/165; 315/173; 315/290; 315/350; 315/351

[58] Field of Search ..... 315/289, 335, 290, 350, 315/351, 165, 173

[56] References Cited

U.S. PATENT DOCUMENTS

| | | | |
|---|---|---|---|
| 1,877,716 | 9/1932 | Claude | 315/335 |
| 2,840,761 | 6/1958 | Williams et al. | 315/289 |
| 3,320,476 | 5/1967 | Beese | 315/351 |
| 3,758,818 | 9/1973 | Kaneda | 315/290 |
| 4,072,878 | 2/1978 | Engel et al. | 315/289 |
| 4,079,292 | 3/1978 | Kaneda | 315/289 |
| 4,403,173 | 9/1983 | Mayer | 315/289 |

*Primary Examiner*—Harold Dixon
*Attorney, Agent, or Firm*—W. G. Fasse; D. H. Kane, Jr.

[57] ABSTRACT

A high intensity discharge (HID) lamp has an arc tube including a pair of main electrodes and at least one auxiliary electrode or probe, wherein a high frequency (HF) high voltage is applied to the probe for forming a high frequency (HF) ignition discharge for establishing a low frequency (LF) arc discharge between the main electrodes. In this ignition system, the electrodes of the arc tube are arranged so that an LF discharge path and an HF discharge path are positioned in an X- or Y-configuration in the arc tube for causing easy lamp ignition. Also, to simplify the outer leads, it is desirable to mount the probe on one of the main electrodes by a dielectric member opposite another main electrode thereby to form a shorter gap between the probe and the other main electrodes than that between the main electrodes. The starting device of HID lamps has a high frequency-high voltage (HF-HV) generator, the output of which is applied, directly or indirectly, to the probe. Accordingly, sure ignition and hot-restrike can be achieved by applying through the outer leads a superimposed voltage including the source voltage and the HF-HV.

10 Claims, 9 Drawing Figures

HIGH INTENSITY DISCHARGE LAMP IGNITION SYSTEM

BACKGROUND OF THE INVENTION

1. Field of the Invention

The present invention relates to a HID lamp having a high efficacy, and to its igniting device. The HID lamp is represented by a metal halide lamp, which is suitable as a white color and home-use light source and which has an arc tube including metal halides such as scandium, sodium and mercury, and filled with an inert gas such as argon.

2. Prior Art

Although a HID lamp, like a metal halide discharge lamp, has the advantages of a high efficacy and high color rendition, it has the significant defect that a hot-restrike or re-starting is very difficult, and disturbs a rapid on and off operation. One of the reasons for this is that the inner pressure in the arc tube remains very high when the lamp is extinguished after the lamp has been lit for several minutes following the initial ignition. In the conventional HID lamp, the initial ignition becomes easier at low voltages due to the establishment of a low pressure glow discharge between one of the main electrodes and a probe. This glow discharge is effective only at the beginning of the lit condition. However, once the glow discharge shifts to arc discharge, the inner temperature and pressure of the arc tube become very high due to the continued arc discharge. In such cases, the re-lighting of the lamp needs a hot re-strike or re-starting voltage of several tens of kilovolts for an arc tube having an electrode gap in the range of a few millimeters up to several ten millimeters.

OBJECTS OF THE INVENTION

In view of the above it is the aim of the invention to achieve the following objects singly or in combination:

- to provide a HID lamp ignition device which is easily able to re-start the lamp by sustaining the arc discharge directly by a commercial voltage source;
- to provide a new and improved HID lamp having a particular electrode arrangement for applying high frequency components to the lamp for facilitating its re-starting; and
- to assure the establishment of a low frequency arc discharge between the main electrodes.

SUMMARY OF THE INVENTION

In the ignition device of the HID lamp according to the invention, an HF-high voltage is first applied between one of the main electrodes and the probe of an auxiliary electrode to produce an HF arc discharge between them. It has been found that the ignition voltage is lowered by the application of an HF component, by which the electrodes are provided with a large amount of energy per unit mass and time. If the HF arc discharge occurs, the conductance between the main electrodes increases, whereby the HF arc discharge may be changed to an LF arc discharge. Once the LF arc discharge is established between the main electrodes, a highly excited state continues around the electrodes thereafter, and the arc discharge between the main electrodes is sustained by the LF-voltage.

As stated above, the HF arc discharge first occurs between the main electrode and the probe, and acts as trigger ignition of HF arc discharge. This is an advantage because it makes the re-starting or hot re-strike easier; it also enhances the initial ignition. However, even if the HF arc discharge is produced between one of the main electrodes and the probe it sometimes fails to establish an LF arc discharge between the main electrodes. The invention avoids this and an LF arc discharge is established with certainty between the main electrodes after an HF arc discharge is produced by applying an HF-high voltage to the lamp. The lamp is constructed so as to first produce an HF arc discharge between a pair of probes of auxiliary electrodes or between a single probe and one of the main electrodes, and then to establish an LF arc discharge by an LF-low voltage applied between the main electrodes.

According to one aspect of the present invention, a HID lamp comprises a pair of opposing main electrodes and a probe arranged in a Y-shaped configuration. The probe is positioned near one of the main electrodes, but spaced by a mounting member of dielectric material so as to oppose another main electorde to form a gap shorter than the gap between the main electrodes. In this arrangement, each electrode and probe can be connected with two outer leads, thus, HID lamps of the two-lead type are sufficient for operating the present lamps.

In another aspect of the present invention, an ignition device of the HID lamp is provided with an HF-HV generator (first boosting means) which is powered by a commercial, a.c. line voltage source, and by means for applying a superimposed voltage of the output of the HF-HV generator and the source voltage through outer leads of the lamp.

In the above lamp ignition device according to the invention, when the a.c. source is turned on, the superimposed voltage of the voltage source (LF-LV) and the generated output voltage (HF-HV) are applied between the main electrodes of the HID lamp for its ignition. The superimposed voltage is also simultaneously applied between the probe and one of the main electrodes through the dielectric HF passing means. Since the probe is arranged with a shorter gap between itself and one main electrode, an HF arc discharge occurs first between this probe gap. The HF arc discharge between the probe and one main electrode causes the conductance between the main electrodes to rise. As a result, an LF arc discharge between the main electrodes is established. On the other hand, even if the LF arc discharge is established between the probe and one of the main electrodes, a large voltage drop would occur across the dielectric member by a flowing discharge current. Accordingly, the voltage applied between the probe and one of the main electrodes will drop smoothly to extinguish the LF arc discharge between the probe and that main electrode. Once the LF arc discharge is established between the main electrodes, the voltage across the lamp is decreased, the operation of the HF-HV generator ceases and it stops supplying the HF-HV output, but the highly excited state in the arc tube of the lamp is maintained thereafter by the voltage source to sustain the LF arc discharge.

A particular HID lamp according to this invention has an arrangement of electrodes in an X-shaped configuration instead of a Y-shape to cross the LF discharge path between the main electrodes and the HF discharge path between a pair of probes or between a single probe and one of the main electrodes in an arc tube. The main feature of this HID lamp is directed to an arrangement of pairs of electrodes and probes or to a single probe in the arc tube to cross the LF main discharge path between the main electrodes and the HF auxiliary discharge path between one of the main electrodes and the single probe or the pair of probes. The use of an HF ignition system in this invention has the advantages of a lower ignition voltage than the LF component and of providing a high energy supply per unit time.

BRIEF FIGURE DESCRIPTION

In order that the invention may be clearly understood, it will now be described, by way of example, with reference to the accompanying drawings, wherein:

FIG. 1 is a principal sectional view of a HID lamp of one embodiment according to the present invention;

FIG. *2a* is a basic block diagram of a lamp ignition device of an embodiment according to the present invention;

FIG. *2b* shows a modification of FIG. *2a;*

DETAILED DESCRIPITION OF PREFERRED EXAMPLE EMBODIMENTS AND OF THE BEST MODE OF THE INVENTION

Figure 1:
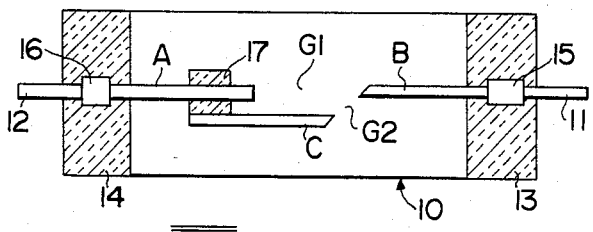

FIG. 1 shows a metal halide lamp, a so-called HID lamp 10 in accordance with the present invention. The lamp 10 comprises electron emitting main electrodes A and B, the end portions of which are made, for example, of a thoriated tungsten rod, etc. Outer leads 11 and 12 are connected to the main electrodes respectively through molybdenum foils 15, 16 for reducing a thermal stress which arises in each press seal portion 13, 14. A ceramic sleeve of dielectric material 17 for providing a capacitance which responds to an HF component is mounted to the main electrode A to connect a probe C to the circumference of the sleeve 17. The main electrodes A and B, and the main electrode B and probe C are respectively positioned to oppose each other, and the main gap G1 between the main electrodes A and B is larger than the other gap G2 between the electrode B and the probe C.

Figure 2A:
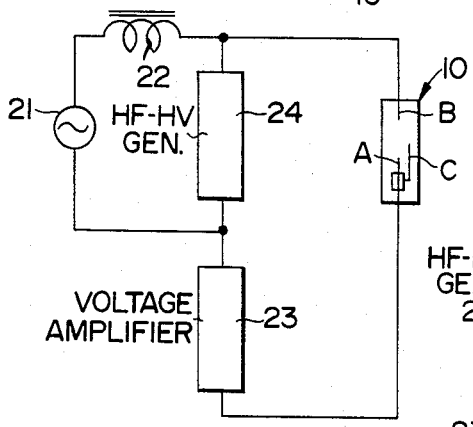
Figure 2B:
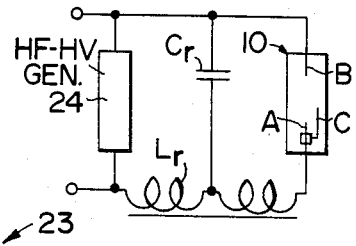

FIG. 2 shows a basic block diagram of a lighting device for operating the HID lamp of FIG. 1. A commercial a.c. source 21 provides the LF-LV input and is connected to an HF-HV generator 24 referred to as first boosting means, through an inductive current limiter 22. Although the output voltage of the HF-HV generator is elevated to between several times, and several tens of times that of the voltage of the source 21, the voltage generated by the HF-HV generator 24 is not sufficiently high for re-starting or hot re-striking of the lamp. Therefore, the output of the HF-HV generator 24 is raised by a second voltage boosting means 23 such as a step-up transformer and an LC circuits as shown in FIG. *2b* resonating at the fundamental or harmonic frequencies of the output voltage. The voltage raise ratio of the boosting means 23 is selected by a choice of its construction to get the HF-high voltage necessary or sufficient for hot re-striking of the lamp 10. The HF boosted voltage superimposed on the source voltage is applied between the main electrodes A and B. The above stated first and second boosting means constitute a high frequency and high voltage generating circuit of the present invention. The second voltage boosting means 23 is not operative against an LF component, whereby the source voltage is applied to the lamp 10 without any noticeable impedance. The first HF-HV generator 24 is arranged so as to cease its operation by establishing an LF arc discharge which causes the lamp voltage to be lowered.

According to the above stated construction, when the source 21 is turned on for re-starting the lamp under the condition that the lit lamp has been extinguished after several minutes of operation, whereby the arc tube remains at a high temperature and high pressure, the source voltage is applied to the HF-HV generator 24 which converts the source voltage into an HF-HV output voltage which is substantially higher, for example, 5 to 20 times higher than the source voltage. This HF-HV output voltage is applied to the second voltage boosting means 23 which further amplifies the HF-HV output, for example, within the range of 20 to 150 times the source voltage in a cascade type voltage amplification.

The HF-HV component and the source voltage are superimposed and applied between the main electrodes of the HID lamp. The shorter gap provided between one main electrode and probe C causes an HF arc discharge to occur first between the main electrode B and probe C by applying the superimposed voltage between the main electrodes A, B. Because of ionization improvement by the HF in the lamp, the discharge ignition voltage between the main electrodes decreases. Accordingly, immediately after the occurrence of the HF arc discharge between the electrodes B and C, an LF arc discharge is established by the source voltage between the main electrodes A and B. On the other hand, when the LF arc discharge occurs between the main electrode B and probe C, a large voltage drop arises across the ceramic sleeve 17 which provides a capacitance. As a result, the HF arc discharge ceases after the LF arc discharge arises between the electrodes B and C. Further, the HF-HV generator 24 is arranged so as to cease its operation when the voltage applied across the outer leads drops due to the fall in impedance across the main electrodes by establishing the LF arc discharge between the main electrodes of the HID lamp 10. Accordingly, the generation of the HF-HV output applied between the main electrodes ceases when the LF arc discharge is established between the main electrodes A and B.

As stated above, the first HF arc discharge occurs by applying the HF-HV component between one main electrode B and probe C, and then an LF arc discharge between main electrodes A and B due to the source voltage is established with the help of the HF arc discharge, so that the lamp is re-started or hot re-struck. After the LF arc discharge arises between the main electrodes A and B, the LF arc discharge is maintained by continuous reignition because the source is not turned off and because the interior of the lamp is maintained in a highly excited state. It is noted that the use of an HF component for the ignition is advantageous because it provides a lot of energy, whereby it becomes possible to produce a higher conductivity and a lower resistivity within the lamp even by a lower voltage.

Figure 3:
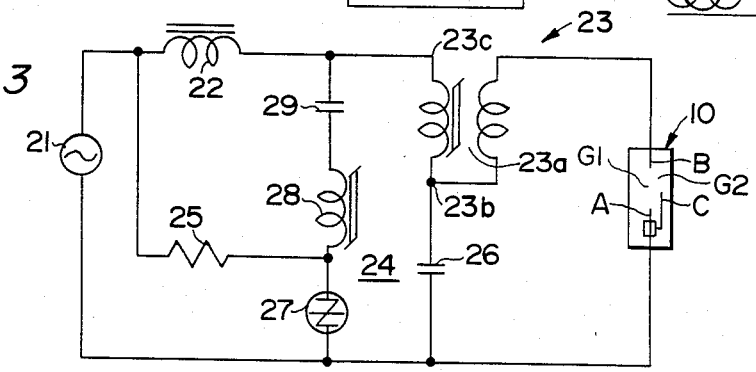
FIG. 3 is a circuit diagram of the ignition device of FIG. 2.

FIG. 3 shows a circuit of the embodiment of the lamp ignition device in FIG. 2, in which a main gap G1 between the main electrodes A and B in the HID lamp 10 is several millimeters wide, and a second gap G2 between the main electrode B and probe C is about 1 millimeter wide. The HF-HV generator 24, or first boosting means, comprises an oscillation capacitor 26, a thyristor 27, a nonlinear inductor 28 and an intermittent oscillation capacitor 29 connected in series. The cooperation of the oscillation capacitor 26 and the nonlinear inductor 28 forms an oscillation booster. The intermittent oscillation capacitor 29 repeats charging and discharging according to an input voltage and assures that the oscillation raise operation takes place intermittently at each half cycle of the voltage source. The second voltage boosting means 23 is constructed with a step-up transformer 23*a* having a step-up ratio in the range of 10 to 15. Additionally, 25 is a resistor to provide a positive bias for the thyristor 27.

According to this circuit, when the source 21 is turned on, the oscillation capacitor 26 is charged through a current limiter 22, and when the terminal voltage of the oscillation capacitor 26 reaches the break-over voltage of the thyristor 27, the thyristor 27 is turned on, and the oscillation step-up operation commences by the cooperation of the oscillation capacitor 26 with the nonlinear inductor 28. The operation takes place at each initial or leading portion of each half cycle of the source voltage.

During this operation in the leading period of each half cycle, HF current with a large amplitude flows intermittently through the primary winding of the transformer 23*a*, generating the HF-HV component. The transformer 23*a* multiplies the HF-HV component corresponding to the winding ratio, and the increased HF-HV component is applied between the main electrodes A and B of the HID lamp 10. Additionally, because the oscillation capacitor 26 forms a high impedance for the LF component, and on the contrary, the first boosting means 24 forms a low impedance for the LF component, the source voltage superimposed with the HF-HV component is applied as is between the main electrodes A and B. Thus, the HF-HV component is also applied between probe C and the main electrode B, so that the HF arc discharge occurs between the electrode B and probe C.

After the formation of the HF arc discharge between the probe C and the main electrode B, an LF arc discharge is established between the main electrodes A and B immediately after the HF arc discharge took place, and the lamp is started. Additionally, when an LF arc discharge takes place between probe C and the main electrode B, a large voltage drop arises due to the capacitance of the ceramic sleeve 17, and prevents the HF arc discharge between probe C and the main electrode B. At the same time, when the LF arc discharge takes place between the main electrodes A and B, the voltage drop between the main electrodes becomes lower than the break-over voltage of the thyristor 27, and the operation of the HF-HV generator 24 ceases. Thereafter, because the interior of the HID lamp is maintained in a highly excited state, the LF arc discharge produced by the source voltage is sustained between the main electrodes A and B.

One end of a secondary winding of the transformer 23*a* in FIG. 3 is connected to a junction 23*b* between a primary winding and the oscillation capacitor 26, but alternatively it may be connected to another junction 23*c* between the primary winding and the intermittent oscillation capacitor 29. Concerning the second voltage boosting means 23, an LC resonance circuit or combination circuits with plural steps may be used as a modification of the transformer 23*a*.

Figure 4:
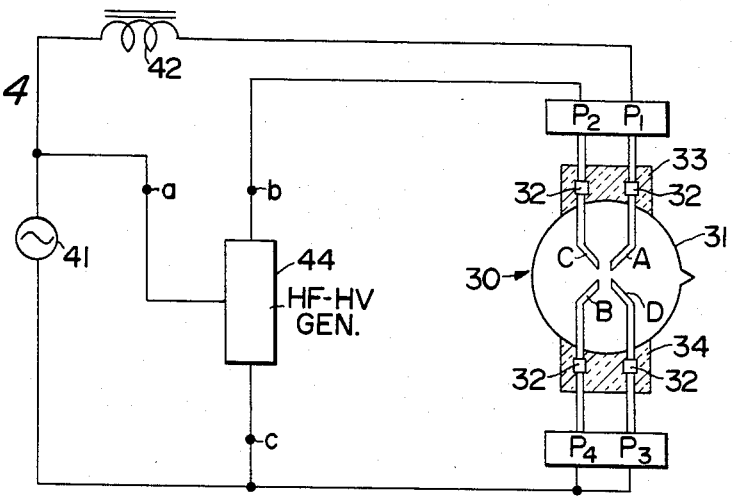
FIG. 4 is a block diagram of another embodiment of a lamp of the present invention suitable for use in FIG. 2.

FIG. 4 shows a block diagram of an ignition device for a HID lamp 30 of another embodiment of the invention. Here, a voltage of a commercial a.c. source 41 is applied between terminals P1 and P4 of the HID lamp 30 through a current limiter 42. Additionally, the source 41 directly drives an HF-HV generator 44 and the output voltage of the HF-HV generator 44 is applied between terminals P2, P3 of the lamp 30. The terminals P3, P4 are connected to a common return path.

The terminals P1, P4 are connected with the main electrodes A and B respectively of an arc tube 31 of the HID lamp 30, and the terminals P2 and P3 are connected with the probes C and D respectively. These electrodes and probes are disposed respectively to oppose each other, and a main LF discharge path formed between the main electrodes A and B and an auxiliary HF discharge path formed between probes C and D cross each other at about the central portion of the arc tube. Additionally, the gap of the auxiliary HF discharge path is shorter than the gap of the main LF discharge path. By means well known to those skilled in the art, molybdenum foils 32 which are provided in press seals 33, 34, serve to reduce the stress caused by a thermal expansion difference between the leads of the electrodes and the press seals 33, 34.

According to the construction stated above, when the source 41 is turned on, the HF-HV generator 44 operates first to generate an HF-HV component which is applied between probes C and D through the terminals P2 and P3, causing an HF arc discharge comparatively easily because of a drop of the ignition voltage due to the HF application and providing a large energy input per unit time. When the HF arc discharge is formed between probes C and D, the conductance of the main LF discharge path is rapidly increased by the induction of the HF arc discharge because the auxiliary HF discharge path and the main LF discharge path cross each other. As a result, the LF arc discharge is caused through the main LF discharge path by the source 41.

As stated above, when the HF arc discharge occurs between probes C and D, the LF arc discharge between the main electrodes A, B is induced by the HF arc discharge. Moreover, the probability of generating the LF arc discharge is extremely high in spite of the source voltage, namely an LF-LV component. This is so because when the HF arc discharge is formed through the auxiliary HF discharge path, the main LF discharge path is also rapidly brought into a highly excited state by ionized ions due to the crossing of the auxiliary HF discharge path between probes C and D and the above stated main LF discharge path. Thus, due to the crossing of the main LF discharge path and the auxiliary HF discharge path with each other, the LF arc discharge through the LF discharge path is induced without failure by the HF arc discharge through the auxiliary HF discharge path.

Figure 5:
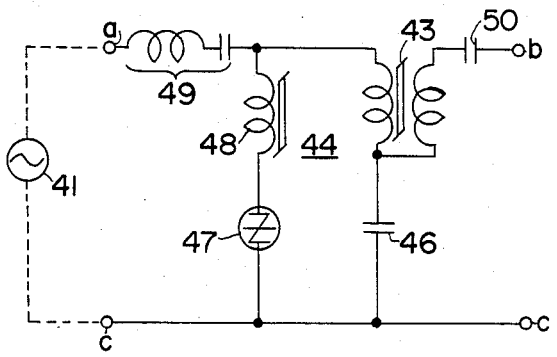
FIG. 5 is a circuit diagram of an HF-HV generator of the ignition device in FIG. 4.

FIG. 5 shows a circuit of the HF-HV generator 44 in the embodiment of the invention shown in FIG. 4. The circuit comprises the HF-HV generator 44 which provides a uniform HF-HV component by an oscillation step-up operation, and a voltage boosting means, such as a step-up transformer 43, which elevates the output voltage of the HF-HV generator. The HF-HV generator comprises an oscillation capacitor 46, and a series circuit of a thyristor 47 and a nonlinear inductor 48 connected in parallel to the capacitor 46. In addition, a series circuit of an inductor and, an intermittent oscillation capacitor 49 is inserted between the series circuit and the voltage source 41. Furthermore, the voltage boosting means comprises a step-up transformer 43 provided with a proper winding ratio between the primary side and the secondary side.

According to the construction stated above, when the source 41 is turned on, the oscillation capacitor 46 is charged through the series circuit of the inductor and the intermittent oscillation capacitor 49, and when the terminal voltage of the oscillation capacitor 46 reaches the break-over voltage of the thyristor 47, the thyristor 47 turns on, and a step-up oscillation operation commences by the cooperation of the oscillation capacitor 46 with the step-up nonlinear inductor 48. The operation takes place at the leading portion of each half cycle of the source voltage due to the operation of the series circuit 49. Because the aforesaid operation occurs at the leading period of each half cycle, a current with a large amplitude flows through the primary winding of the step-up transformer 43. The step-up transformer 43 further increases the induced voltage by the HF current corresponding to the winding ratio, and the output is applied between probes C and D through a capacitor 50.

The winding ratio of the step-up transformer 43 is selected to a certain degree to increase the output voltage of the HF-HV generator 44 by up to several times, e.g., 12 times. As a result, the high voltage in combination with the high frequency is applied between probes C and D, and accordingly an initial ignition or a hot re-strike of the lamp occurs easier due to the HF arc discharge that preceded it.

Further, in this embodiment, the circuit 44 is so arranged that it stops the oscillating operation when the impedance between connection points b and c becomes low or when the lamp voltage becomes lower than the break-over voltage of the thyristor 47. Additionally, the capacitor 50 is selected so that the terminal voltage of the capacitor becomes high, e.g., 10,000 volts if the LF arc discharge current flows. Accordingly, when the HF arc discharge occurs between probes C and D, the impedance between probes C and D, and also between the main electrodes becomes low. Even if the oscillation step-up operation does not cease, the LF arc discharge between probes C and D ceases because of the high voltage across the capacitor 50. That is, according to this embodiment, an HF arc discharge arises through the auxiliary discharge path and induces the establishment of an LF arc discharge through the main discharge path, and at the same time, the HF arc discharge through the auxiliary discharge path ceases automatically. Therefore, an arc discharge through the auxiliary discharge path never arises thereafter during the lit condition.

Still further, in practical application, a second boosting means 23 is mounted in the base of a lamp envelope so as to permit decreasing the distribution line voltage at the base below a dangerous valve, such as 4 kV.

Figure 6:
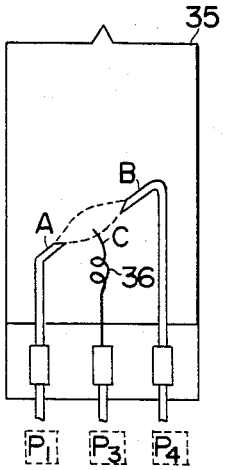
FIG. 6 is a sectional view of a HID lamp showing another embodiment of the present invention.

FIG. 6 shows another HID lamp using a single probe in accordance with this invention, wherein the lamp arrangement causes an HF arc discharge between one of the main electrodes A, B and the single probe C due to HF high voltage, and to establish an LF arc discharge between the main electrodes due to HF arc discharge. In the HID lamp 35 of FIG. 6, an HF-high voltage is applied between the terminal P3 of a single probe C and the terminal P1 of a main electrode A, and an LF-LV source voltage is applied between the terminals P1 and P4. In FIG. 6, an auxiliary discharge path is formed to include a portion of the main discharge path between the main electrodes. That is, the position of the electrodes is so arranged that the top portion of probe C is positioned in the main discharge path. The lamp igniting means are entirely similar to those of the aforesaid embodiments, that is, an HF arc discharge occurs first through the auxiliary discharge path, and then the HF arc discharge induces the establishment of an LF arc discharge through the main discharge path. Due to the HF arc discharge through the auxiliary discharge path between the main electrode A and probe C, the conductance of the main discharge path is rapidly increased, and the LF arc discharge arises by LF low voltage between the main electrodes A and B. According to the positioning of the electrode, the probe may be heated up during the normal lamp lighting operation due to the position of the top portion of probe C in the main discharge path. Therefore, the probe C is provided with a radiator 36 for heat dissipation.

Figure 7:
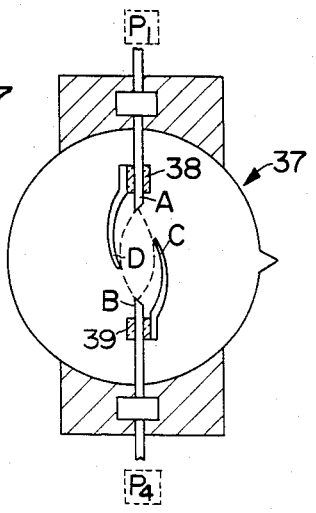
FIG. 7 is a sectional view of a HID lamp showing a further embodiment of the present invention.

FIG. 7 shows a further embodiment of a HID lamp of the invention, wherein a lamp 37 is similar to the embodiment shown in FIG. 4 as far as the location of the electrodes and probes are concerned. A pair of opposing probes C and D and a pair of opposing main electrodes A and B are arranged as shown. The following features are also similar to FIG. 4. The main discharge paths formed between the probes cross each other, and the gap of the auxiliary discharge path is constructed to be shorter than that of the main discharge path. The difference is in mounting the probes C and D respectively on dielectric main electrodes to pass the HF component. Accordingly, two outer leads of the lamp are necessary, and a superimposed voltage of the HF-HV and the LF-LV components is applied between the pair of outer lead terminals P1 and P4.

Figure 8:
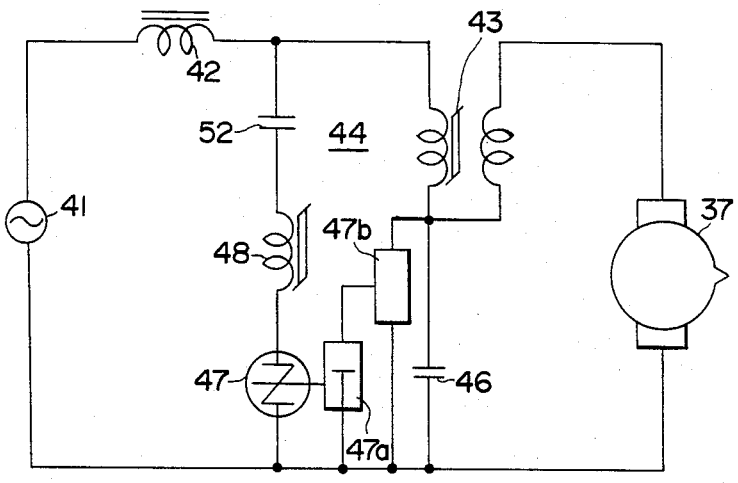
FIG. 8 is a circuit diagram of a lamp igniting device for the HID lamp of FIG. 7.

FIG. 8 shows an igniting circuit suitable for the lamp of FIG. 7, wherein first and second boosting means are almost similar to the circuit shown in FIG. 5. The differences are in the connection of an intermittent capacitor 52 in series with a nonlinear inductor 48, and the connection of the HF-HV generator 44 to an a.c. source 41 through a current limiter 42. According to such differences, the output of the secondary side of the step-up transformer 43 becomes the superimposed voltage of the source voltage and the HF-high voltage. That is, the superimposed voltage of the LF-LV and the HF-HV is applied between the outer lead terminals P1 and P4 of the HID lamp 37 in FIG. 7.

In addition, a triac type thyristor 47 has a gate circuit **47*a* and a smoothing circuit 47*b* across the capacitor 46, whereby the highest voltage ratio is obtained, because the break-over voltage of the thyristor 47** is raised with the increase of the output voltage.

When the above superimposed voltage is applied between the terminals P1 and P4, the HF-HV component is applied between probes C and D through each of the ceramic sleeves 38 and 39. Because the gap between probes C and D is shorter than that between the main electrodes A and B, an HF arc discharge occurs first between these probes. The HF arc discharge rapidly increases the conductance of the main discharge path crossing the auxiliary discharge path, and the main discharge path is brought into a highly excited state. Consequently, an LF arc discharge is also formed by the LF-LV component of the source voltage. Such an operation takes place in almost the same way in the case of an initial ignition and in the case of a hot re-strike. Because the HF-HV generator is arranged to cease oscillating when the output side impedance decreases, namely when the LF arc discharge is established through the main discharge path, the oscillation ceases gradually. That is, the HF arc discharge is shifted to the LF arc discharge with an overlap of time. Additionally, when an LF arc discharge takes place through the auxiliary discharge path, a large voltage drop arises due to the capacitance of each of the ceramic sleeves 38, 39. Accordingly, an HF arc discharge occurs through the auxiliary discharge path, an LF arc discharge is established simultaneously through the main discharge path, and the application of the HF-HV component between the probes ceases gradually. Once the LF arc discharge is established through the main discharge path, the highly excited state through the main discharge path is maintained to sustain the LF arc discharge. As stated above, the HID lamp comprising two outer leads is operated satisfactorily and it is convenient for handling. Further, because a part of each probe is not located in the main discharge path different from the example of FIG. 6, consumption of the probe is substantially prevented.

According to the foregoing embodiments relating to HID lamps and lighting devices, a HID lamp, in one aspect of this invention, comprises a pair of opposing main electrodes and a probe mounted on one of the main electrodes with a gap that is shorter than that between the main electrodes. In another aspect of this invention, an ignition device comprises an HF-HV generator driven by a commercial power source and means of providing a voltage superimposed on the source voltage and the HF-HV output generated by the HF-HV generator to be applied between the main electrodes of the HID lamp, so as to surely and simply achieve an initial ignition and hot re-strike or re-starting. In particular, a provision of the probe on the main electrode by inserting a capacitance such as a space gap or a dielectric member therebetween makes possible the automatic control of the supplied HF-HV component due to the voltage drop across the capacitive impedance, and the arc discharge by the LF-LV is sustained through the main discharge path. Therefore, the hot re-strike or re-starting difficulty of the prior HID lamps is avoided by this invention. In this embodiment, the hot re-strike is achieved in a lamp of small size, e.g., having a diameter of 10 mm, within the time of 10 to 30 seconds, whereas in the conventional case several minutes are required. Also, the construction of the lighting device for HID lamps is simplified by providing second boosting means within the envelope of the lamp. Reliability of the lighting operation is also improved by the sufficiency of two outer leads due to the reduction of connection points.

In this ignition system for HID lamps, electrodes of the lamp are arranged to form a discharge path crossing the LF discharge path formed by a pair of main electrodes and the HF discharge path formed by at least one probe with each other. It is noted that the HF arc discharge occurs first through an auxiliary discharge path which serves to highly excite the main LF discharge path gradually and reliably, and that the LF arc discharge is reliably established by the LF-LV component through the main LF discharge path at the starting time of the initial ignition as well as at a re-starting, whereby the time required for the establishment of the LF arc discharge is advantageously much shorter than in the prior art.

Although the invention has been described with reference to specific example embodiments, it will be appreciated that it is intended to cover all modifications and equivalents within the scope of the appended claims.

What is claimed is:

1. An ignition system for a HID lamp, comprising an arc tube with lead-in terminal means, auxiliary first electrode means for forming a first arc discharge path inside said tube, main second electrode means for forming a second arc discharge path inside said tube, high frequency high voltage generating means operatively connected to said first discharge path forming means for applying a booster power to said first discharge path forming means in the form of a high frequency high voltage for first generating a first arc discharge in said first arc discharge path, a.c. power input means operatively connected to said second discharge path forming means for applying an a.c. power to said second means for sustaining a second arc discharge in said second arc discharge path after the second arc discharge has first been started by said first arc discharge, said first discharge path being shorter than said second discharge path for establishing a stable rapid ignition of said HID lamp under all operating conditions, said system further comprising mounting means for mounting said auxiliary first electrode means on said main second electrode means, said mounting means forming a capacitance for passing a high frequency power component supplied through a lead-in terminal means of at least one main second electrode means.

2. The system of claim 1, wherein said first and second discharge path means are arranged relative to each other so that the respective discharge paths cross each other.

3. The system of claim 1, wherein said auxiliary first electrode means of said first arc discharge path comprise high frequency electrode means, and wherein said main second electrode means of said second arc discharge path comprise low frequency electrode means.

4. The system of claim 3, wherein said high frequency electrode means comprise a single auxiliary electrode, and wherein said low frequency electrode means comprise a pair of main electrodes.

5. The system of claim 4, wherein said mounting means comprise a mounting member for mounting said single auxiliary electrode on one of said main electrodes, said mounting member forming a capacitance for passing a high frequency power component supplied through a respective lead-in terminal means of said respective main electrode.

6. The system of claim 4, wherein said single auxiliary electrode, of which a top portion is located at an intermediate position between said main electrodes, comprises a radiator for heat dissipation.

7. The system of claim 3, wherein said low frequency electrode means comprise a pair of main electrodes, and wherein said high frequency electrode means comprise a pair of auxiliary electrodes, said mounting means comprising two mounting members for mounting said auxiliary electrodes to said main electrodes each of said mounting members forming a respective capacitance.

8. A lighting circuit for a HID lamp having an arc tube provided with a plurality of outer leads for supplying a high frequency power component and a low frequency power component to the lamp, comprising an a.c. source, a current limiter connected in series with said a.c. source, voltage boosting circuit means connected across said a.c. source for producing a high frequency and high voltage power output, and means for connecting said lamp leads to the series circuit of said a.c. source and said current limiter, said voltage boosting circuit means including an oscillation capacitor and a series circuit of a nonlinear inductor and thyristor means connected across said oscillation capacitor for providing a high frequency high voltage, whereby said lamp is operable for ignition and hot re-strike by applying first said high frequency and high voltage power component from said voltage boosting circuit means, and subsequently said low frequency and low voltage power component from said a.c. source to said connecting means, said lighting circuit further comprising second voltage boosting means connected between said first voltage boosting circuit means and said HID lamp for further amplifying said high frequency high voltage in a cascading type of voltage amplification for assuring said hot re-strike, said first voltage boosting circuit means further comprising an intermittent oscillator to produce an intermittent high frequency high voltage oscillation power output.

9. The lighting circuit of claim 8, wherein said second voltage boosting means comprises a step-up transformer to increase the voltage of said high frequency power component, whereby a stable hot re-strike of said lamp is achieved.

10. The lighting circuit of claim 8, wherein said second voltage boosting means comprises resonance circuit means for increasing said high frequency high voltage power component, whereby a stable hot re-strike of said lamp is achieved.

* * * * *